US009114959B1

(12) United States Patent
Gallet

(10) Patent No.: US 9,114,959 B1
(45) Date of Patent: Aug. 25, 2015

(54) REMOVAL TOOL

(71) Applicant: David John Gallet, Corona, CA (US)

(72) Inventor: David John Gallet, Corona, CA (US)

(73) Assignee: David John Gallet, Corona, CA (US)

( * ) Notice: Subject to any disclaimer, the term of this patent is extended or adjusted under 35 U.S.C. 154(b) by 0 days.

(21) Appl. No.: 14/498,817

(22) Filed: Sep. 26, 2014

Related U.S. Application Data

(60) Provisional application No. 61/883,616, filed on Sep. 27, 2013.

(51) Int. Cl.
*B66C 1/48* (2006.01)
*B66C 1/44* (2006.01)

(52) U.S. Cl.
CPC .. *B66C 1/442* (2013.01); *B66C 1/48* (2013.01)

(58) Field of Classification Search
CPC ..... B66C 1/48; B66C 1/422; B66C 1/442; Y10S 294/901
USPC ..... 294/101, 104, 110.1, 901
See application file for complete search history.

(56) References Cited

U.S. PATENT DOCUMENTS

| | | | | | |
|---|---|---|---|---|---|
| 761,282 | A | * | 5/1904 | Aires | 294/101 |
| 1,279,274 | A | * | 9/1918 | Comrie | 294/104 |
| 2,324,362 | A | * | 7/1943 | Chandler | 294/104 |
| 2,412,555 | A | * | 12/1946 | Baker | 294/104 |
| 3,257,143 | A | * | 6/1966 | Wansley | 294/101 |
| 3,356,406 | A | * | 12/1967 | Renfroe | 294/101 |
| 3,442,548 | A | * | 5/1969 | Archer | 294/104 |
| 4,702,508 | A | * | 10/1987 | Weiner et al. | 294/101 |

FOREIGN PATENT DOCUMENTS

DE 29512659 * 10/1995

* cited by examiner

*Primary Examiner* — Dean Kramer

(57) ABSTRACT

A removal system is configured to remove plywood from ground. The removal system includes a gripping assembly that is configured to fit around the plywood. A pressure assembly is attached to the gripping assembly and configured to apply pressure onto the plywood in order to trap the plywood between the pressure assembly and the gripping assembly. A tether is attached to the pressure assembly and configured to provide an upward force on the gripping assembly and a lateral force on the plywood in order to remove the plywood from the ground.

5 Claims, 3 Drawing Sheets

REMOVAL TOOL

RELATED APPLICATION

This application claims priority to provisional patent application U.S. Ser. No. 61/883,616 filed on Sep. 27, 2013, the entire contents of which is herein incorporated by reference.

BACKGROUND

The embodiments herein relate generally to construction of structures and machine tools used therein.

Pouring concrete into the ground within designated boundaries can be a challenging procedure. This involves excavating a trench, lining the trench with plywood, pouring the concrete and then removing the plywood. Prior to embodiments of the disclosed invention, there was no good way for removing the plywood from the trench. Embodiments of the disclosed invention solve this problem.

SUMMARY

A removal system is configured to remove plywood from ground. The removal system includes a gripping assembly that is configured to fit around the plywood. A pressure assembly is attached to the gripping assembly and configured to apply pressure onto the plywood in order to trap the plywood between the pressure assembly and the gripping assembly. A tether is attached to the pressure assembly and configured to provide an upward force on the gripping assembly and a lateral force on the plywood in order to remove the plywood from the ground.

In some embodiments, the gripping assembly further includes a first wall mechanically coupled to a contact surface. A second wall can be mechanically coupled to the contact surface. Contact surface teeth can be mechanically coupled to the contact surface. The contact surface teeth can be configured to further grip the plywood to assist in removal of the plywood.

In some embodiments, the contact surface can be a tongue further comprising a tongue hole point. The tether passes through the tongue hole point.

In some embodiments, the pressure assembly can further comprise a lobe that further comprises a lobe rounded section joined with a first lobe straight section and a second lobe straight section. A contact grip surface can be on the lobe rounded section. A tether link attachment point can be attached to the first lobe straight section and further attached to the tether. A lobe handle can be attached to the second lobe straight section and partially covered with a lobe handle grip.

In some embodiments, an assembly bolt can be inserted through a first wall attachment fastener point in the first wall, a lobe connection channel in the lobe and a second wall attachment fastener point in the second wall. A nut can secure the assembly bolt in position.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
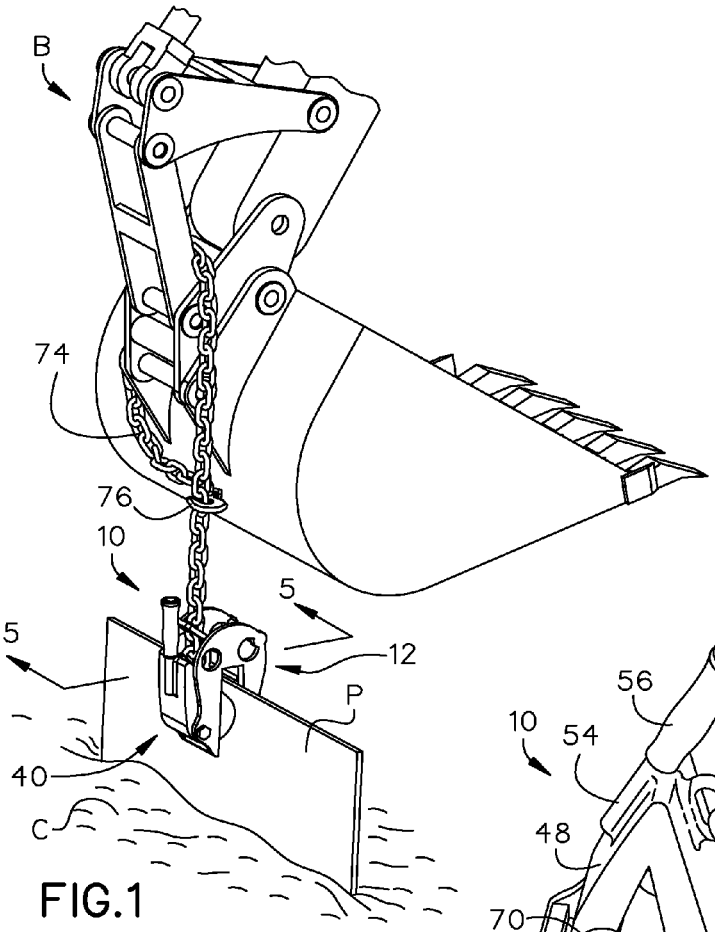
FIG. 1 is a perspective view of an embodiment of the invention shown in use.

By way of example, and referring to FIG. 1, a user desires to use backhoe B to remove plywood P from ground C. In some embodiments ground C can be soil, sand, clay, concrete or another similar substance. Removal tool 10 accomplishes this by compressing plywood P between gripping assembly 12 and pressure assembly 40. Pressure assembly 40 is mechanically coupled to tether 74, which can be wrapped around backhoe B and held in place with hook 76. In some embodiments tether 74 can be a chain or cable.

Figure 2:
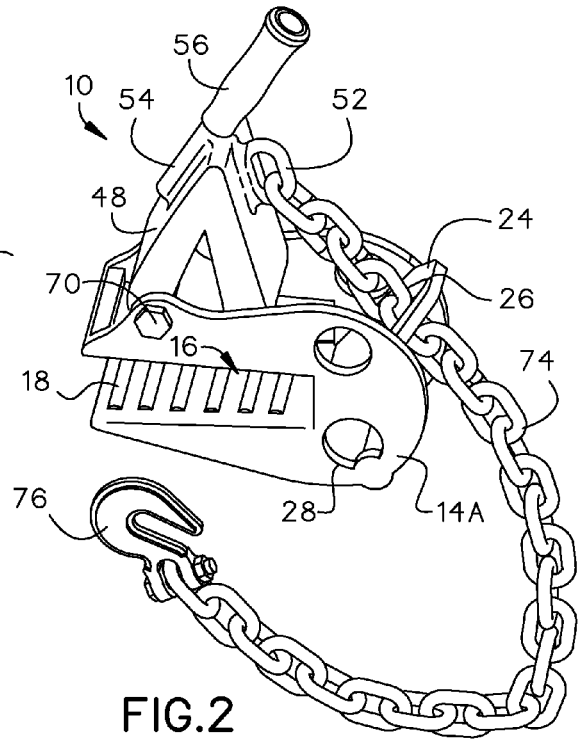
FIG. 2 is a top perspective view of an embodiment of the invention.
Figure 3:
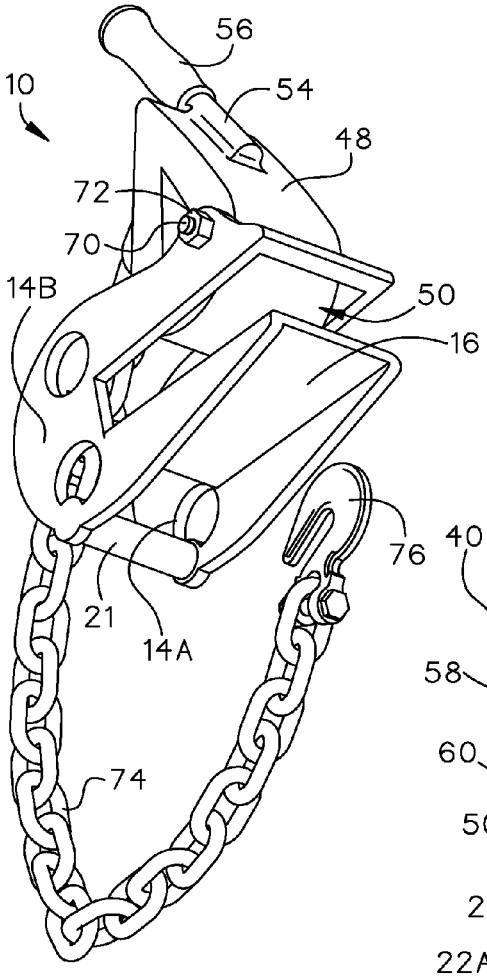
FIG. 3 is a bottom perspective view of an embodiment of the invention.
Figure 4:
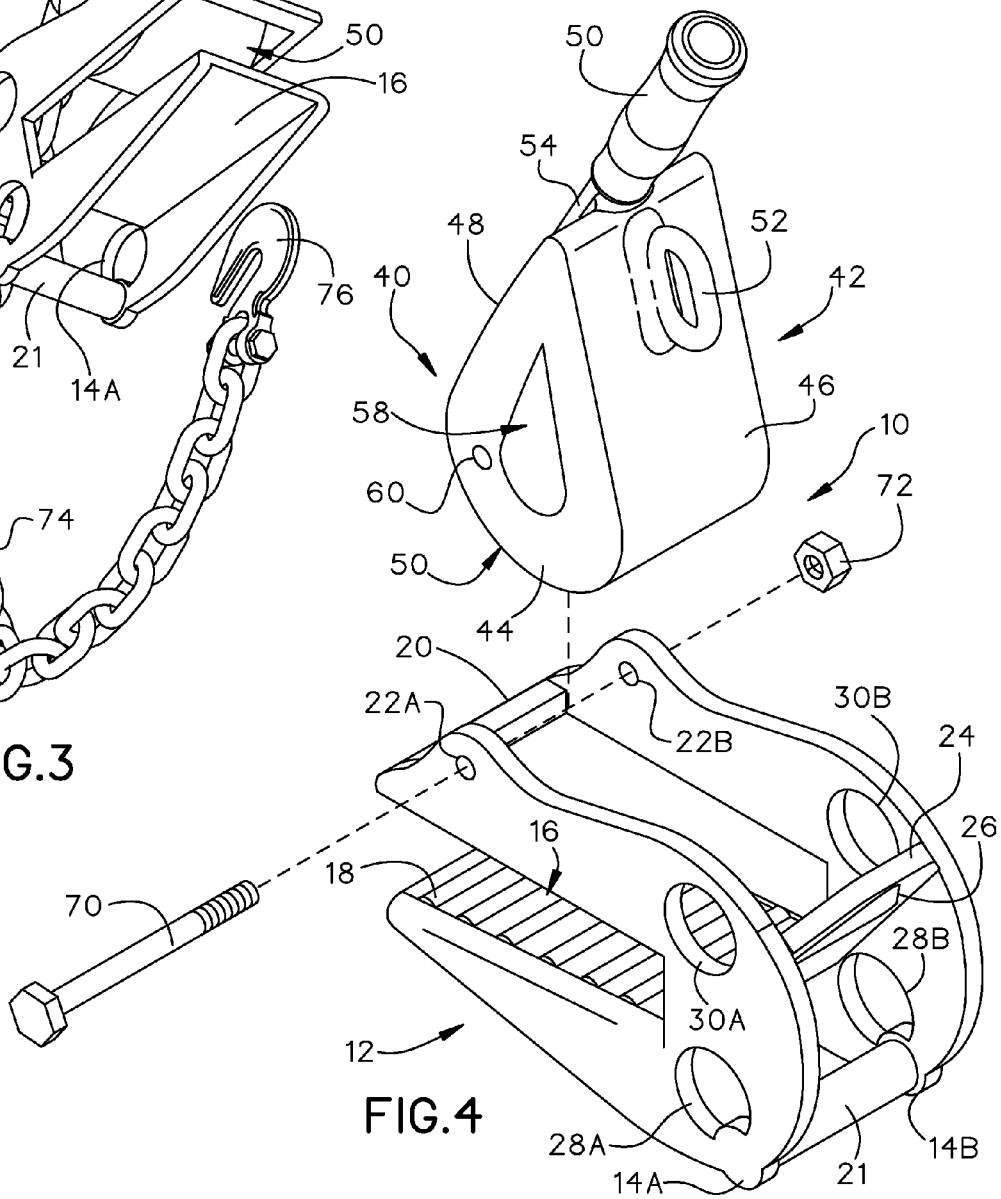
FIG. 4 is an exploded view of an embodiment of the invention (omitting tether for illustrative clarity).

FIG. 2, FIG. 3, and FIG. 4 show these components in more detail. Gripping assembly 12 further comprises first wall 14A mechanically coupled to contact surface 16. Contact surface 16 is further mechanically coupled to second wall 14B. Contact surface 16 is further mechanically coupled to contact surface teeth 18. A first wall forward portion is mechanically coupled to a second wall forward portion with forward block 20 for greater stability. Near forward block 20, first wall 14A is perforated at first wall attachment fastener point 22A. Likewise, second wall 14B is perforated at second wall attachment fastener point 22B. A first wall rearward portion is mechanically coupled to a second wall rearward portion with rearward dowel 21 for greater stability.

A first wall rear portion is mechanically coupled to a second wall rear portion with tongue 24. Tongue 24, is shown as an upward and rearward extension of contact surface 16, but that arrangement is not required. Tongue 24 is perforated at tongue hole point 26. First wall 14A is further perforated at first wall rear lower perforation point 28A and first wall rear upper perforation point 30A. Similarly, second wall 14B is further perforated at second wall rear lower perforation point 28B and second wall rear upper perforation point 30B.

Pressure assembly 40 further comprises lobe 42. Lobe 42 further comprises lobe rounded section 44 joined with first lobe straight section 46 and second lobe straight section 48. Lobe rounded section 44 includes contact grip surface 50. First lobe straight section 46 is mechanically coupled to tether link attachment point 52. Second lobe straight section 48 is mechanically coupled to lobe handle 54. Lobe handle 54 is partially covered with lobe handle grip 56. In some embodiments lobe handle grip 56 can be made from a high friction surface such as rubber. Lobe 42 can comprises a hollow inner section 58 to reduce the weight of lobe 42. However, lobe 42 should be made to ASTM A36 standard with a yield force of at least 36 KSI. Lobe 42 is further perforated with lobe connection channel 60.

To assemble removal tool 10, assembly bolt 70 is inserted through first wall attachment fastener point 22A, lobe connection channel 60 and second wall attachment fastener point 22B. Then, nut 72 is attached to assembly bolt 70 to hold assembly bolt 70 in place. This should permit tether link attachment point 52 to rotate through, or at least near, tongue hole point 26. A user can then attach tether 74 through tongue hole point 26 to tether link attachment point 52. Tether 74 is further mechanically coupled to hook 76.

Figure 5:
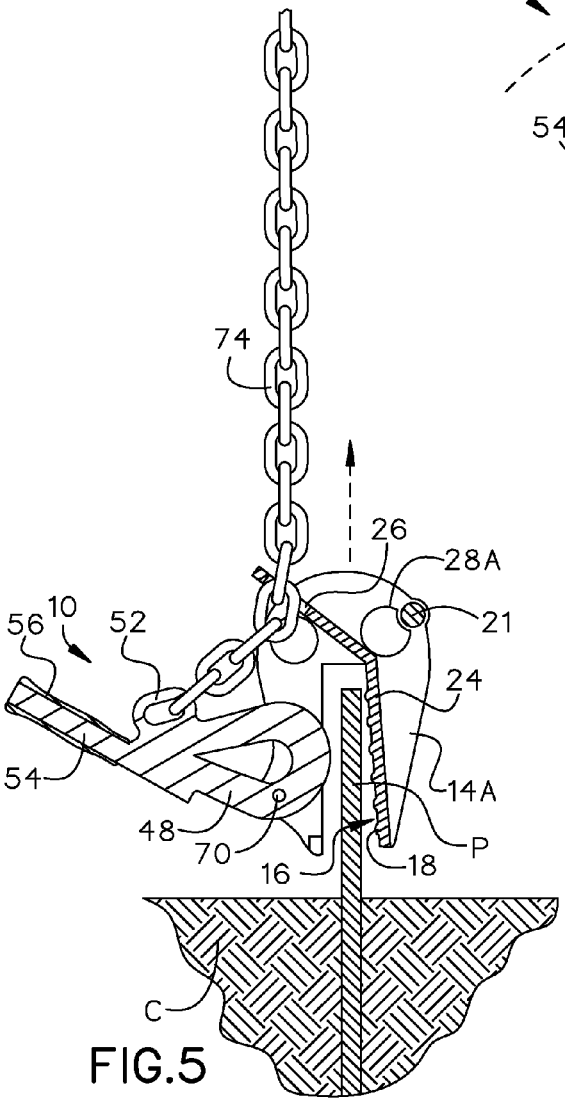
FIG. 5 is a section detail view of an embodiment of the invention long line 5-5 in FIG. 1.
Figure 6:
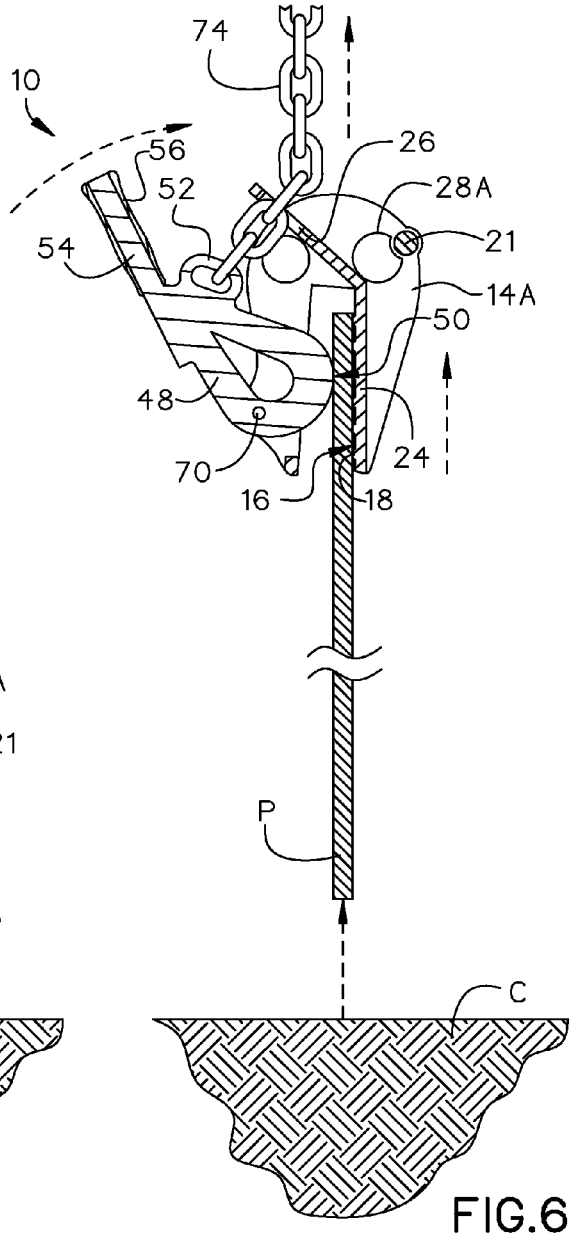
FIG. 6 is a section detail view of an embodiment of the invention shown in use demonstrating removal of plywood component.

FIG. 5 and FIG. 6 show one theory of how to use removal tool 10. After assembly, removal tool 10 is opened by pulling lobe handle 54 away from pressure assembly 40, moving contact grip surface 50 away from contact surface teeth 18. Then, plywood P is arranged between contact grip surface 50 and contact surface teeth 18. Next, backhoe B pulls tether 74 upward causing tether link attachment point 52 to be pulled toward tongue hole point 26. This traps plywood P between contact grip surface 50 and contact surface teeth 18 with a lateral force that applies pressure to plywood P. At this point, an upward force on tether 74 removes plywood P from ground C.

The system components described herein can be made of known materials using known manufacturing techniques. However, testing on the system revealed that materials which comport with ASTM A36 standard with a yield force of at least 36 KSI enable the system to remove plywood with up to 5000 lbf without fracturing the plywood.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A removal system, configured to remove plywood from ground; the removal system comprising:

a gripping assembly, configured to fit around the plywood;

a pressure assembly, attached to the gripping assembly and configured to apply pressure onto the plywood in order to trap the plywood between the pressure assembly and the gripping assembly;

wherein the pressure assembly further comprises:

a lobe that further comprises a lobe rounded section joined with a first lobe straight section and a second lobe straight section;

a contact grip surface on the lobe rounded section;

a tether link attachment point attached to the first lobe straight section and further attached to a tether; and a lobe handle attached to the second lobe straight section and partially covered with a lobe handle grip;

the tether, attached to the pressure assembly and configured to provide an upward force on the gripping assembly and a lateral force on the plywood in order to remove the plywood from the ground.

2. The removal system of claim 1, wherein the gripping assembly further comprises:

a first wall mechanically coupled to a contact surface;

a second wall mechanically coupled to the contact surface;

contact surface teeth mechanically coupled to the contact surface;

wherein the contact surface teeth are configured to further grip the plywood to assist in removal of the plywood.

3. The removal system of claim 2, wherein the contact surface is a tongue further comprising a tongue hole point; wherein the tether passes through the tongue hole point.

4. A removal system configured to remove plywood from ground; the removal system comprising:

a gripping assembly, configured to fit around the plywood; wherein the gripping assembly further comprises:

a first wall mechanically coupled to a contact surface; wherein the contact surface is a tongue further comprising a tongue hole point; wherein a tether passes through the tongue hole point a second wall mechanically coupled to the contact surface;

contact surface teeth mechanically coupled to the contact surface;

wherein the contact surface teeth are configured to further grip the plywood to assist in removal of the plywood;

a pressure assembly, attached to the gripping assembly and configured to apply pressure onto the plywood in order to trap the plywood between the pressure assembly and the gripping assembly;

wherein the pressure assembly further comprises:

a lobe that further comprises a lobe rounded section joined with a first lobe straight section and a second lobe straight section;

a contact grip surface on the lobe rounded section;

a tether link attachment point attached to the first lobe straight section and further attached to the tether; and a lobe handle attached to the second lobe straight section and partially covered with a lobe handle grip;

the tether, attached to the pressure assembly and configured to provide an upward force on the gripping assembly and a lateral force on the plywood in order to remove the plywood from the ground.

5. The removal system of claim 4, further comprising:

an assembly bolt, inserted through a first wall attachment fastener point in the first wall, a lobe connection channel in the lobe and a second wall attachment fastener point in the second wall; and a nut, securing the assembly bolt in position.

* * * * *